United States Patent [19]

Hall

[11] 4,051,680

[45] Oct. 4, 1977

[54] MODIFIED RANKINE CYCLE ENGINE APPARATUS

[76] Inventor: Carroll D. Hall, Rte. 1 Box 5X, Talihina, Okla. 74571

[21] Appl. No.: 428,031

[22] Filed: Dec. 26, 1973

[51] Int. Cl.[2] ..... F01K 19/00

[52] U.S. Cl. ..... 60/689; 60/670; 60/654

[58] Field of Search ..... 60/65, 67, 92, 93, 107, 60/36, 651, 671, 670, 654, 689, 694

[56] References Cited

U.S. PATENT DOCUMENTS

| | | | |
|---|---|---|---|
| 1,504,723 | 8/1924 | Schmidt | 60/94 |
| 2,278,085 | 3/1942 | Ostermann | 60/94 |
| 3,314,236 | 4/1967 | Zanoni | 60/107 |
| 3,336,013 | 8/1967 | Salo | 60/107 |
| 3,686,867 | 8/1972 | Hull | 60/65 |

*Primary Examiner*—Allen M. Ostrager
*Attorney, Agent, or Firm*—James C. Wray

[57] ABSTRACT

A modified Rankine cycle steam engine apparatus employs a jet pump to withdraw cooled steam from an adiabatic expansion engine and return the steam to a boiler for reheating. The jet pump draws the expanded, spent steam from the expansion engine into a throttled flow of steam passing through the jet pump from two tap-off points in the boiler.

10 Claims, 2 Drawing Figures

MODIFIED RANKINE CYCLE ENGINE APPARATUS

BACKGROUND OF THE INVENTION

The present invention is a modified Rankine cycle steam engine employing a jet pump to recirculate spent steam. The prior art contains disclosure of specific jet pump designs, disclosure of jet pumps and condensers used in an unmodified Rankine cycle engine, and disclosure of a non-condensing Rankine cycle engine. A need exists for a simple, efficient steam engine which does not employ a condensing unit.

A collection of devices of the type known in the prior art is found in the Official U.S. Patent Office Classification of Patents, particularly in class 60, subclasses 65, 92, and 107. Examples of such devices are found in U.S. Pat. Nos. 3,686,867; 3,314,236; 1,982,060; and 1,668,927.

Hull U.S. Pat No. 3,686,867 has regenerative feed heaters which operate on portions of steam withdrawn from initial turbine stages and water from the condenser.

Zanoni U.S. Pat No. 3,314,236 employs a jet pump driven by energy remaining in steam portions exhausted from initial turbine stages to reheat and drive water from a condenser toward the boiler. Zanoni teaches the use of tandem combinations of jet pumps.

McCallum U.S. Pat No. 1,982,060 is an example of the use of a "steam-water" feed pump for increasing pressure to the boiler.

Stumpf U.S. Pat No. 1,668,927 describes the use of steam exhausted from one cylinder of a piston engine to draw steam from other cylinders. Stumpf particularly notes that he uses no condenser; the working fluid remains in a gaseous state while passing through the engine and is discharged when spent rather than recirculated.

A need exists for easily fabricated steam handling system which reduces the exhaust line pressure of an expansion engine and recirculates the spent steam to the boiler where it is reheated.

SUMMARY OF THE INVENTION

The present invention is a modified Rankine cycle engine apparatus in which a gaseous working fluid is heated, by a hot reservoir while contained in a vessel, expanded adiabatically to produce mechanical work, and returned to the heated vessel in a gaseous state by means of a jet pump.

Heat is initially applied to the working fluid of the apparatus by a heated vessel which contains the working fluid. In a preferred embodiment of the present invention, the working fluid is steam, and the heated vessel is tubular coils placed in thermal contact with a chemically fired furnace. The heating is isobric, and the pressure of the fluid at one end of the tubular coil is nearly equal to the pressure at the other end.

The heated working fluid passes from one end of the tubular heating coil to an expansion engine. In the engine it undergoes an adiabatic expansion during which some of the heat energy of the fluid is converted into mechanical work. In one preferred embodiment the engine is a turbine. In another embodiment the engine is a reciprocating piston engine.

The engine is exhausted of the cooled and expanded working fluid by a jet pump. The jet pump forces the spent fluid back into the tubular coil where it is reheated. A fluid current is established through the jet pump by a pump intake conduit connecting one end of the heated tubular coil to the main flow intake port of the pump. The combined mass of fluid from the main intake port and expanded fluid from the engine exit the pump from the main flow exhaust port and return to a second end of the tubular heating coil by means of a pump exhaust conduit.

The operation of the jet pump is explained as follows. The boiler pressure at the main flow intake port of the pump forces the fluid through an injector nozzle within the pump, thereby increasing the fluid velocity and decreasing the pressure of the fluid beyond the nozzle. This expanded fluid combines with the spent fluid from the expansion engine, passes out of the jet pump, and returns to the heated tubular coil.

The pumping action results from throttling action of the jet pump. As the fluid passes from the main flow intake port of the pump into the pump nozzle, the fluid is under high pressure and is at a high temperature. As the fluid is ejected from the nozzle into the combining tube, much of the available energy becomes kinetic energy. As the combining tube tapers down, the pressure of the fluid increases; thereby, expelling the combined mass of fluid out of the jet pump and into the heating vessel.

In a preferred embodiment of the present invention, a plurality of jet pumps are placed in tandem. The suction port of each pump is connected to the engine to exhaust the spent fluid. A fluid flow is set up from the first end of the tubular heating coil; through the main flow intake port, nozzle, and combining tube of the first jet pump; and from there into the main flow intake port of the second jet pump. The fluid flow continues through each successive pump in this manner, until it exits the last pump and returns to the second end of the tubular heating coil. In one form of the invention, the pump suction ports may receive fluid expelled from different ports of the engine at different pressures.

In another preferred embodiment of the present invention, a main shut-off valve is inserted in the conduit supplying the engine with heated fluid from the tubular coil. A first pump shut-off valve is inserted in the pump intake line between the heating coil and the pump intake port. A second pump shut-off valve is inserted in the pump exhaust line between the pump and the second end of the heating coil. The addition of the valves is to facilitate starting and stopping of the engine. To start the engine, the pressure at the suction port of the jet pump must be less than the pressure in the heating coil in order to induce a velocity through the pump. The valves in the pump intake and pump exhaust conduits allows pressure in the heating tube to build up. When the first and second pump shut-off valves are opened, a flow is set up through the pump. When the main shut-off is opened, the apparatus begins to produce mechanical energy. The engine may be stopped by first, closing the main shut-off valves; and finally, cooling the heated vessel.

An object of the present invention is to replace the condenser in a Rankine cycle engine apparatus with a jet pump to reduce back pressure on the expansion engine.

Another object of the present invention is to eliminate the secondary fluid cooling system commonly associated with Rankine cycle engines.

Another object of the present invention is to eliminate heat loss from the working fluid of a Rankine cycle engine.

These and other objects and features of the invention are apparent from the disclosure, which includes the specification with the foregoing and ongoing description and with the claims, and which includes the drawings.

DETAILED DESCRIPTION OF THE DRAWINGS

Figure 1:
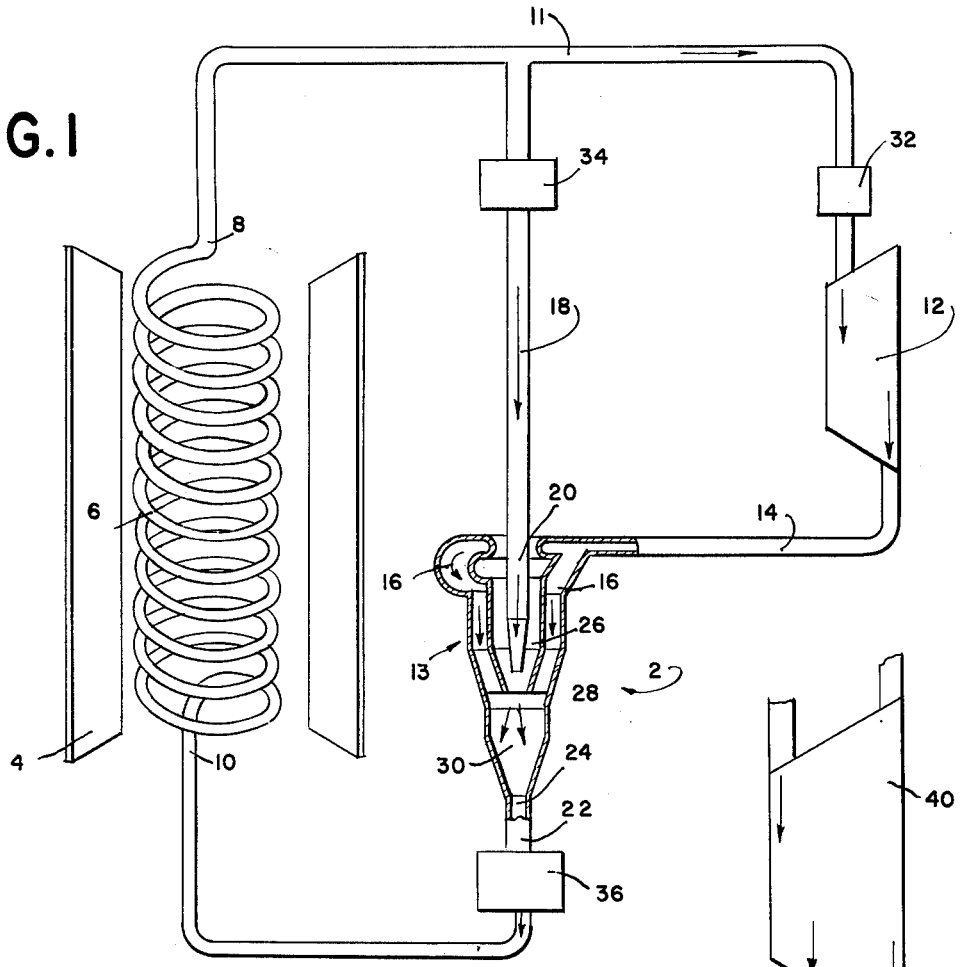
FIG. 1 is a schematic representation of the modified Rankine cycle engine apparatus of the present invention.

Referring to FIG. 1 a schematic representation of the modified Rankine cycle engine apparatus of the present invention is denoted generally by the numeral 2. A heat reservoir 4 is in thermal contact with a fluid heating vessel 6 which contains a gaseous working fluid. In preferred embodiments of the present invention, the heat reservoir is a chemically fired furnace, the fluid heating vessel is a tubular coil or boiler, and the gaseous working fluid is steam.

The working fluid is free to exit the heated vessel by means of a fluid conduit attached to a first portion 8 of the vessel, and the fluid is free to enter the vessel by means of a fluid conduit attached to a second portion 10 of the vessel. Pressurized, heated fluid passes through engine intake conduit 11 into adiabatic expansion engine 12. Spent, expanded fluid is pumped to the second portion of the heating vessel 10 by a jet pump, denoted generally by the numeral 13.

Spent working fluid is drawn from the expansion engine through engine exhaust conduit 14 into jet pump suction ports 16. Within the jet pump, the spent fluid exhausted from the engine combines with a fluid flow set up between pump intake conduit 18 and pump exhaust conduit 22. Fluid from the first portion 8 of the heated vessel passes into the jet pump through main flow intake port 20. The flow is throttled by a nozzle structure 26 in the jet pump. Fluid from the nozzle and spent fluid from the expansion engine combine in the combining region 28 of the pump. The pump housing tapers to a smaller cross-sectional area in region 30 and forms the main flow exhaust port 24. Spent fluid from the engine and fluid from the first portion of the heated vessel are returned to the second portion of the heated vessel 10 by pump exhaust conduit 22.

In the preferred embodiment of the present invention shown in FIG. 1, a main throttle valve 32 is located in the engine intake conduit 11. A first pump throttle valve 34 is located in the pump intake conduit 18, and a second pump throttle valve 36 is located in the pump exhaust conduit 22. The throttle valves facilitate the starting and stopping of the engine apparatus. The engine apparatus is started by applying heat to the heating vessel, and then opening all of the throttle valves. The apparatus is stopped by first closing the main throttle valve 32, then closing the first and second pump throttle valves, 34 and 36, and, finally, removing heat from the heating vessel.

Figure 2:
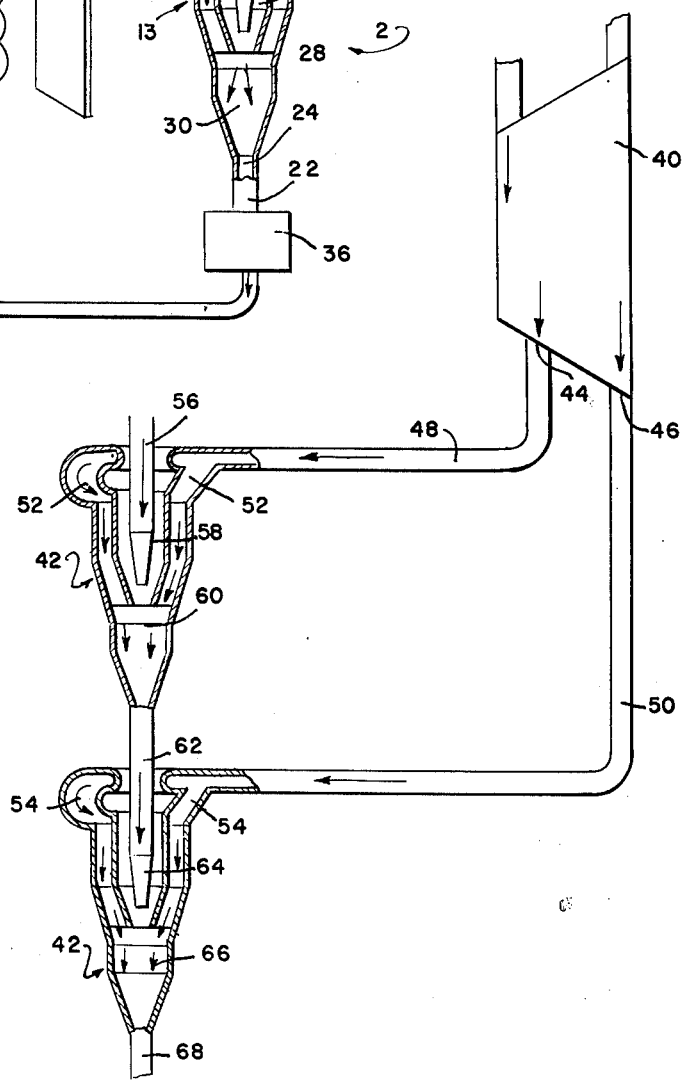
FIG. 2 is a schematic representation of a portion of a preferred embodiment of the present invention employing tandem jet pumps to exhaust the expansion engine.

FIG. 2 is a schematic representation of expansion engine and pump assemblies of a preferred embodiment of the present invention employing tandem jet pumps to exhaust the expansion engine. The FIGURE shows two tandem jet pumps denoted generally by numerals 42 and 43. The first jet pump 42 in the tandem combination exhausts the expansion engine 40 through a first engine exhaust conduit 48. The first pump receives the spent fluid from the engine through suction ports 52. Similarly, the second jet pump 43 exhausts the engine through a second engine exhaust conduit 50A and the spent fluid derived thereby passes into the second pump through suction ports 54.

A main flow of working fluid is set up through both jet pumps. Working fluid from the first portion of the heated vessel travels through pump intake conduit 56 into the first jet pump. Within the pump, it is throttled by nozzle structure 58 and combines with spent fluid from the expansion engine in the combining area 60. The flow path is partly constricted as the fluid passes out of the first pump and through the main flow intake port 62 of the second pump. The main flow of working fluid is constrained to pass through the nozzle structure 64 of the second pump after which it combines with spent gas from the engine in combining region 66 before ultimately returning to the heating vessel via pump exhaust conduit 68.

To accomodate a plurality of jet pumps, the expansion engine employed in the apparatus is equipped with a number of fluid exhaust ports. The embodiment depicted in FIG. 2 has two engine exhaust ports 44 and 46. The fluid stream exhausted from each exhaust port need not be from the same expansion stage of the engine, and each stream can be at a different pressure.

Although FIG. 2 shows the use of two jet pumps in tandem, a larger number of pumps can be operated in tandem in an analogous manner.

The system employs "parallel" and "series" modes of operation. A parallel system has the main flow intake ports of each of several pump connected to the first portion of the heating vessel, the main flow exhaust port of each pump is connected to the second portion of the heating vessel, and the suction port of each pump is connected to the exhaust conduit coming from the exhaust side of the engine. A series system uses one or more pumps with intakes connected to exhausts of preceding pumps and suction sides connected to engine exhausts. Pressure produced by the jet pump is greater than pressure leading into the boiler and thus causes the desired flow of fluid. Since this is the case, an automatically-opening check valve can be substituted for the shut-off valve mounted in the pump exhaust conduit. When the shut-off valve in the pump intake conduit is opened, an imbalance in pressures is created. The pressure acting on the surface of the poppet valve in the pump exhaust is greater than the combination of pressures exerted on the back side of the valve and pressure of a spring on the back side of the valve. The spring is marginally necessary to keep the valve shut when there is no fluid flow. The combination of forces exerted by the spring and pump exhaust pressure reacts to overwhelm that of the boiler intake pressure, thus opening the vavle and ensuring fluid flow in a second embodiment. A spring is used or a pump exhaust side of a pump exhaust valve in the second embodiment to compensate for force deviations caused by a smaller valve face toward the pump exhaust and a larger valve face toward the boiler intake.

In both cases, when the shut-off valve in the pump intake conduit is closed, pump exhaust pressure becomes less than boiler intake pressure and the check valve closes. Automatic valves may be used either separately or in the same body as the pump, as method of starting and stopping the system. The pressure at the jet pump inlet may be nearly the same as the pressure at the jet pump exhaust. Boiler pressure forces the steam out of the jet pump injector nozzle, thereby increasing velocity and decreasing pressure to some amount less than in the engine exhaust, thus starting the combination of injector steam and any vapor available at the engine exhaust. Any cooling that takes place occurs in the jet pump position 16, due to the lessening of pressure at that point. Energy available at the jet pump intake, high pressure and high temperature, changes primarily into kinetic energy in the inlet nozzle. As the jet pump combining tube begins to taper down, pressure begins to increase, compressing injector steam and engine exhaust, and kinetic energy decreases. The heat energy converted at kinetic energy becomes available as pressure as the diameter of the combining tube becomes smaller. Finally, the pressure of the steam becomes great enough to overcome boiler intake pressure, thus causing the injector steam and any exhaust steam to be circulated back into the boiler. Steam at this point quickly becomes equal in pressure to that in the boiler. However, steam at the boiler intake is cooler than that available at the high-pressure side of the engine. At that point, heat energy is added to keep the cycle working.

There need not be any steam available at the engine exhaust. The workability of the system depends entirely upon the energy available at the jet pump intake and upon the pressure necessary to overcome at the boiler intake. The system may be used in a stop-and-start situation, such as an automobile engine, because the jet pump flow would not have to be interrupted substantially to allow or remove steam available at the engine exhaust.

This invention is effective with several different fluids and mixtures of fluids. For example, fluorocarbons such as freon may be used in the Rankine cycle variation. Water and water-chemical mixes may be in my cycle. All types of fluids may be used with boiling points within the range presently encompassed by the state of the art. All fluids are capable of being used in this cycle, subject only to restrictions imposed by materials strengths and temperature limits. The cycle is applicable in situations, employing high-vapor-pressure fluids, such as solar furnaces used for power production, or in any other application wherein ambient, or slightly above ambient, temperture is used to vaporize fluids with extremely low boiling points to produce power. At the other end of the scale, the cycle might be usable in atomic power plants which use mercury to cool the cores, even though the temperatures range above those of the conventional steam power plants.

In addition to turbines and reciprocating piston engines, all types of rotary piston and rotary vane engines may be used.

Any heat source is suitable for use in the system of this invention, for example, solar radiation, atomic power plants, including heat from the cores themselves, and heat from existing heat transfer systems such as mercury coolant and warm water and hot air resevoirs which can be used to vaporize the low-boiling-point-fluids mentioned before. The cycle is effective with any type or design of device which transmits energy from the heat resevoir to the heating vessel by radiation, convection, or conduction.

The present invention may employ as heat vessels any and all vessels capable of accepting heat and capable of sustaining the pressures dictated by the energy levels attained.

While the invention has been described with reference to specific embodiments, it will be obvious that modifications and variations may be constructed without departing from the spirit and scope of the invention. The scope of the invention is described in the following claims.

I claim:

1. A modified Rankine cycle engine apparatus comprising a heat reservoir, a working fluid having a gaseous phase a fluid heating vessel, which heating vessel is in thermal contact with the heat reservoir, the heating vessel having an inlet and an outlet, and which heating vessel contains a portion of the gaseous phase of the working fluid, which experiences heating while within the heating vessel, a first conduit having a first end connected to the outlet and having a second end an engine in which heated working fluid undergoes an approximately adiabatic expansion, thereby converting a portion of heat energy of the working fluid into mechanical work, an engine intake conduit having a first end connected to the first conduit and having a second end connected to the engine, thereby connecting the engine to the outlet of the fluid heating vessel, through which conduits the heated working fluid passes to the engine, a jet pump with a suction port, a main flow intake port and a main flow exhaust port, an engine exhaust conduit connecting the engine to the suction port of the jet pump, through which conduit expanded, spent working fluid passes from the engine, a pump intake conduit having a first end connected to the first conduit and having a second end connected to the pump main flow intake port, thereby connecting the outlet of the heating vessel to the main flow intake port of the jet pump, through which heated working fluid passes into the jet pump and into and through a nozzle structure within the pump, and a pump exhaust conduit connecting the main flow exhaust port of the jet pump with the inlet of the heating vessel, through which fluid from the suction port and the main flow intake port passes out of the jet pump and returns to the heating vessel;

whereby, an adiabatic expansion engine, supplied with a heated, pressurized working fluid is exhausted by a jet pump, and spent working fluid is returned to a heating vessel for reheating.

2. The modified Rankine cycle engine apparatus of claim 1 wherein the gaseous working fluid is a fluid capable of being heated, expanded, compressed and driven at temperatures and pressures available from the heating vessel.

3. The modified Rankine cycle engine apparatus of claim 1 wherein the engine in which the working fluid undergoes an approximately adiabatic expansion is a turbine.

4. The modified Rankine cycle engine apparatus of claim 1 wherein the engine in which the working fluid undergoes an approximately adiabatic expansion is a variable chamber engine.

5. The modified Rankine cycle engine apparatus of claim 1 wherein the heat reservoir is a source of thermal energy at some temperature relatively elevated with respect to engine temperature.

6. The modified Rankine cycle engine apparatus of claim 1 wherein the heating vessel is an elongated single pass heating device maintained in thermal contact with the heat reservoir.

7. The modified Rankine cycle engine apparatus of claim 1 further comprising additional jet pumps connected in parallel with the jet pump of claim 1, so that each of the jet pumps exhaust the engine through their respective suction ports; and, so that, a main flow intake port of a first pump is connected to the first portion of the heating vessel, main flow exhaust ports of each of all but a last pump are connected to the main flow intake port of a successive pump, and a main flow exhaust port of a last pump is connected to the second portion of the heating vessel.

8. The modified Rankine cycle engine apparatus of claim 1 further comprising a first pump throttle valve in the pump intake conduit, a second pump throttle valve in the pump exhaust conduit, and a main throttle valve in the engine intake conduit of the engine;

whereby, the engine apparatus is started by applying heat to the heating vessel and then opening the first and second throttle valves and the main throttle valves; and whereby, the engine apparatus is stopped by first closing the main throttle valve, then closing the first and second throttle valves, and removing heat from the heating vessel.

9. The modified Rankine cycle engine apparatus of claim 1 further comprising additional jet pumps connected in series with the jet pump of claim 1, so that each of the jet pumps exhaust the engine through their respective suction ports; and, so that, main flow intake ports of all pumps are connected to the first portion of the heating vessel, and main flow exhaust ports of all pumps are connected to the second portion of the heating vessel.

10. The modified Rankine cycle engine apparatus of claim 1 further comprising a pump throttle valve in the pump intake conduit, a pump throttle automatic check valve in the pump exhaust conduit, for permitting flow away from the pump, a main throttle valve in the engine intake conduit of the engine;

whereby, the engine apparatus is started by applying heat to the heating vessel and then opening the pump throttle valve and the main throttle valve; and, whereby the engine is stopped and started by closing and opening the main throttle valve, and whereby the entire apparatus is stopped by closing the main throttle valve, then closing the pump throttle valve and removing heat from the heating vessel.

* * * * *